US007444100B2

(12) United States Patent
Sato

(10) Patent No.: US 7,444,100 B2
(45) Date of Patent: Oct. 28, 2008

(54) IMAGE FORMING APPARATUS WITH A REMOVABLE HOLDER FOR HOLDING DEVELOPING DEVICES

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 99 days.

(21) Appl. No.: 11/317,171

(22) Filed: Dec. 27, 2005

(65) Prior Publication Data

US 2006/0140669 A1 Jun. 29, 2006

(30) Foreign Application Priority Data

Dec. 27, 2004 (JP) ..... 2004-378084

(51) Int. Cl.
*G03G 15/01* (2006.01)
*G03G 21/16* (2006.01)

(52) U.S. Cl. ..... 399/110; 399/112; 399/121

(58) Field of Classification Search ..... 399/110, 399/111, 124, 125, 112, 121, 299, 302; 347/138, 347/152

See application file for complete search history.

(56) References Cited

U.S. PATENT DOCUMENTS 5,298,946 A * 3/1994 Haneda et al. ..... 399/112
6,484,003 B2 * 11/2002 Tokutake et al. ..... 399/110
6,647,227 B2 * 11/2003 Yokoi et al. ..... 399/111
6,647,228 B2 11/2003 Nakamura et al.
6,697,586 B2 * 2/2004 Yamamoto et al. ..... 399/110
6,707,480 B2 * 3/2004 Ameyama et al. ..... 399/110 X
6,708,011 B2 3/2004 Nomura et al.
6,741,820 B2 * 5/2004 Nobe et al. ..... 399/110
6,882,823 B2 4/2005 Matsuyama
7,065,311 B2 6/2006 Okabe
7,239,825 B2 7/2007 Ohama
2001/0019418 A1 9/2001 Kataoka et al.
2002/0094217 A1 * 7/2002 Miyamoto et al. ..... 399/299
2003/0161656 A1 8/2003 Miura et al.
2004/0022556 A1 2/2004 Nomura
2004/0091290 A1 5/2004 Yamada et al.
2004/0101328 A1 5/2004 Kimura et al.
2004/0208670 A1 * 10/2004 Abe ..... 399/110
2004/0228655 A1 * 11/2004 Sunohara ..... 399/124

FOREIGN PATENT DOCUMENTS

CN 1475866 A 2/2004

(Continued)

OTHER PUBLICATIONS

Machine translation of JP 2003-316233 A dated Feb. 29, 2008.*
EP Search Report dtd Jun. 14, 2007, EP Appln. 05028106.2, 8 pages.
CN Office Action dtd Feb. 22, 2008, CN App 2005101073759 (No English Translation Provided).

*Primary Examiner*—Sophia S Chen
(74) *Attorney, Agent, or Firm*—Banner & Witcoff, Ltd.

(57) ABSTRACT

An image forming apparatus is provided which includes a housing, a series of photoconductors on which an electrostatic latent image is formed, and developing devices, which each include a developing agent carrier for holding a developing agent. Also, the apparatus may include a holder, which is removable from the housing, for supporting the photoconductors and the developing devices, and an image reader provided at a top portion of the housing, which is configured to read an image on a document.

40 Claims, 10 Drawing Sheets

FOREIGN PATENT DOCUMENTS

| | | | |
|---|---|---|---|
| CN | 1512274 | A | 7/2004 |
| CN | 1534392 | A | 10/2004 |
| EP | 03070455 | A2 | 11/1989 |
| EP | 0407183 | A2 | 7/1990 |
| EP | 1008917 | A2 | 6/2000 |
| EP | 1347344 | A2 | 9/2003 |
| JP | 08-054817 | A | 2/1996 |
| JP | 10-187002 | A | 7/1998 |
| JP | 2001-272899 | A | 10/2001 |
| JP | 2001-341883 | A | 12/2001 |
| JP | 2002-108172 | A | 4/2002 |
| JP | 2002-131997 | A | 5/2002 |
| JP | 2002-132011 | A | 5/2002 |
| JP | 2002-214874 | A | 7/2002 |
| JP | 2002-297000 | A | 10/2002 |
| JP | 2003-015378 | A | 1/2003 |
| JP | 2003-015497 | A | 1/2003 |
| JP | 2003-076106 | A | 3/2003 |
| JP | 3447497 | B2 | 7/2003 |
| JP | 2003-280491 | A | 10/2003 |
| JP | 2003-287992 | A | 10/2003 |
| JP | 2003-316104 | A | 11/2003 |
| JP | 2003-316105 | A | 11/2003 |
| JP | 2003-316233 | A | 11/2003 |
| JP | 2004-094151 | A | 3/2004 |
| JP | 2004-109455 | A | 4/2004 |
| JP | 2004-206071 | A | 7/2004 |

* cited by examiner

IMAGE FORMING APPARATUS WITH A REMOVABLE HOLDER FOR HOLDING DEVELOPING DEVICES

CROSS REFERENCE TO RELATED APPLICATION

This application claims priority from Japanese Patent Application No. 2004-378084, filed Dec. 27, 2004, the entire subject matter of which is incorporated herein by reference.

TECHNICAL FIELD

Aspects of the invention relate to an image forming apparatus that transfers onto a recording medium a visible image formed by developing an electrostatic latent image with a developing agent.

BACKGROUND

Known image forming apparatuses form an image on a recording medium, such as a sheet, by forming an electrostatic latent image on an image carrying member and developing the electrostatic latent image with a developing agent. In such an image forming apparatus, a cartridge including the image carrying member and a developing device, or a belt unit for conveying a sheet are removably set in a main housing of the image forming apparatus, to enable the maintenance of the image forming apparatuses or a sheet jam clearing operation to be performed.

To remove the cartridge or the belt unit from the main housing, the cartridge or the belt unit is vertically pulled. For example, Japanese Laid-Open Patent Publication No. 2004-206071 discloses a method to remove the belt unit from an upper potion of the image forming apparatus and the cartridge from a front face of the image forming apparatus.

In some image forming apparatuses, the cartridge or the belt unit is horizontally disposed and is pulled horizontally from the main housing. Japanese Laid-Open Patent Publication No. 2003-015378 discloses an image forming apparatus in which the cartridge is horizontally movable.

In the image forming apparatus disclosed in Japanese Laid-Open Patent Publication No. 2004-206071, the belt unit and the cartridge are separately removable from and installable in the image forming apparatus resulting in good maintainability. However, when the belt unit is pulled out from the upper portion of the image forming apparatus, a relatively strong force is required to remove the belt unit from the image forming apparatus.

In the image forming apparatus disclosed in Japanese Laid-Open Patent Publication No. 2003-015378, the cartridge is horizontally moved to remove it from the main housing of the image forming apparatus. Thus, the cartridge can be removed from the image forming apparatus with a lighter force. However, in this image forming apparatus, the cartridge and the belt unit are not individually accessible. Therefore, the cartridge has to be drawn out from the main housing first, for example, before the belt can be replaced, which leads to a complicated replacement operation and results in poor maintainability.

SUMMARY

Aspects provide an image forming apparatus with good maintainability.

BRIEF DESCRIPTION OF THE DRAWINGS

Illustrative aspects will be described in detail with reference to the following figures wherein.

DETAILED DESCRIPTION

General Overview

Figure 1:
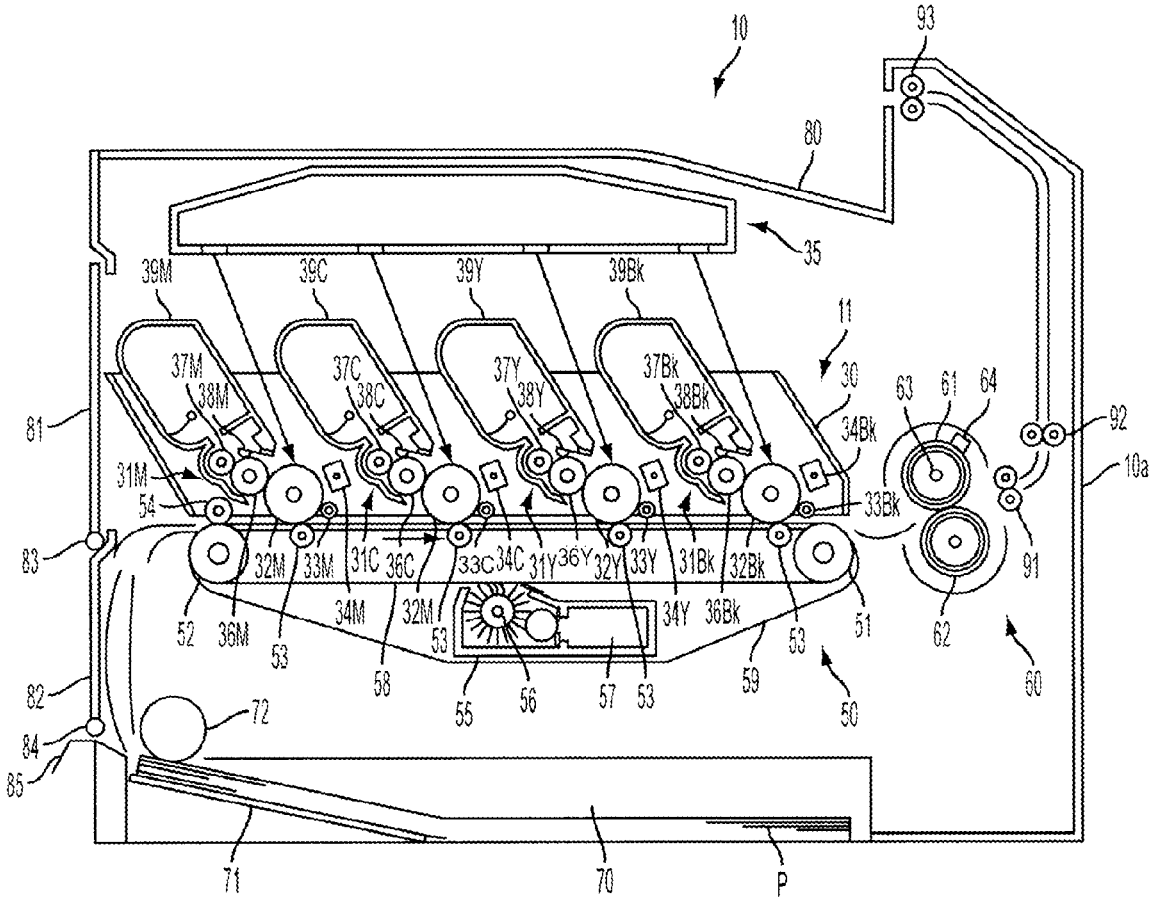
FIG. 1 is a sectional side view of a general configuration of a printer according to an illustrative aspect.

In aspects, an image forming apparatus may include a housing; a photoconductor on which an electrostatic latent image is formed, the photoconductor being supported by a supporting shaft; developing devices, each including at least a developing agent chamber configured to include a developing agent and a developing agent carrier configured to hold the developing agent thereon; a transfer device configured to transfer the visible image formed on the photoconductor to a recording medium; a first holder configured to hold the developing devices along a first direction perpendicular to the supporting shaft of the photoconductor, the first holder being placed in a first area in the housing; a first guide configured to guide the first holder in and out of the first area in the first direction; a second holder configured to hold at least a belt member and a roller for supporting the belt member, the second holder being placed in a second area in the housing; and a second guide configured to guide the second holder in and out of the second area in a second direction parallel to the first direction.

In the image forming apparatus with such a structure, the developing devices may be held by the first holder. The first holder may be guided by the first guide, such that the first holder may be removably set in the housing. Therefore, the developing devices may be readily removed from or set in the first holder, leading to improvement of maintainability. Similarly, the second holder holding the belt member may be moved such that the second holder may be removably set in the housing. Thus, the setting or removal of the belt member may be facilitated.

Further, in the image forming apparatus, the first holder and the second holder may be drawn in a direction perpendicular to the supporting shaft for supporting the photoconductor. Therefore, a space may not be required on a side to which the supporting shaft is drawn (i.e., a large hole may not have to be formed in a frame for supporting the supporting shaft). Thus, the supporting shaft may be stably supported and the rigidity of the image forming apparatus may be increased.

In aspects of the image forming apparatus, the first holder and the second holder may be independently moved by the first guide and the second guide, respectively.

The developing devices and the belt member may be individually removed for replacement. Therefore, time and trouble may be saved as compared with a case where the developing devices are first removed and then the belt member is removed. Thus, maintainability may be improved.

In another aspect of the image forming apparatus, the first guide and the second guide may make the photoconductor and the belt member contact with each other when the first holder and the second holder are placed in the first area and the second area, respectively. The first guide and the second guide may separate the photoconductor and the belt member from each other while the first holder and the second holder are moved to the first drawing position and the second drawing position, respectively.

By moving the first holder and the second holder relative to the housing along the first guide and the second guide, respectively, the photoconductor and the belt member may make contact with each other or be separated from each other. Therefore, a mechanism for contacting or separating the photo conductor and the belt member may not have to be provided in the image forming apparatus, leading to simple structures. Accordingly, costs of the image forming apparatus may be reduced. In addition, a user may removably set the first holder and the second holder readily and promptly. Thus, the image forming apparatus with ease of use may be provided.

In certain aspects, the image forming apparatus may further include a first cover for covering the first area; and a second cover for covering the second area. The first cover may be configured to be moved and the second cover may be configured to be moved relative to the first cover.

When the first holder or the second holder is removed, the first area and the second area may be covered by the first cover and the second cover, respectively. Therefore, such a case may be prevented that the image forming apparatus may topple over when both first holder and the second holder are removed at a time. As compared with a case where the areas are exposed, exposure to dust or debris may be prevented. Thus, deterioration of the image forming apparatus or an image may be prevented.

In some aspects, the image forming apparatus may further include a sheet container configured to include the recording medium before an image is formed, the sheet container being configured to be attachable to and removable from the housing; and a third guide configured to guide the sheet container in a third direction parallel to the first direction.

The image forming apparatus may be provided with the sheet container configured to include a recording medium before an image is formed. The sheet container may be configured to be attachable to and removable from the housing in the same direction as the first direction. Thus, the image forming apparatus with ease of use and good maintainability may be provided. Further, spaces for removably setting the first and second holders and the sheet container may be provided only on the same one side of the image forming apparatus. Thus, limitations on installation of the image forming apparatus may be reduced.

In other aspects, the image forming apparatus may further include an image reading device configured to read an image and generate image data, the image reading device being disposed at an upper portion of the housing; and an electrostatic latent image forming device configured to form the electrostatic latent image on the photoconductor based on the image data generated by the image reading device.

With such a structure, an image on a recording medium may be read and then formed. Thus, the image forming apparatus with ease of use may be provided. When the image reading device is disposed at an upper portion of the housing, rigidity may be required for the image forming apparatus. However, in the above-described structures, rigidity of the image forming apparatus may be improved, so that rigidity of the image forming apparatus may be maintained even when the image reading device is disposed an upper portion of the housing.

In another aspect, the image forming apparatus may further include a discharging portion configured to discharge the recording medium on which the image is formed. The discharging portion may be disposed between the image reading device and the housing.

A discharging portion configured to discharge the recording medium on which the image is transferred may be disposed between the image reading device of the image forming apparatus and the image forming apparatus. Therefore, the discharging portion may not protrude or stand out in the image forming apparatus, as compared with a case where the discharging portion is disposed on one side of a front or rear end, or a left or right end of the housing of the image forming apparatus. Thus, the space may be saved.

Illustrative Aspects

Illustrative aspects will be described with reference to the accompanying drawings. FIG. 1 is a sectional side view of a general configuration of a printer 10 according to an illustrative aspect. The left and right sides in FIG. 1 are defined as front and rear sides of the printer 10.

As shown in FIG. 1, the printer 10 is a so-called tandem color laser printer. The printer 10 includes a housing 10*a*, a visible image forming unit 11, a belt unit 50, a fixing unit 60, a sheet supplying unit 70, a sheet output tray 80, and an exposure device 35.

According to visible image forming processes with developing agents of magenta (M), cyan (C), yellow (Y), and black (Bk) toner, the visible image forming unit 11 is provided with developing devices 31M, 31C, 31Y, 31Bk, organic photoconductive (OPC) drums 32M, 32C, 32Y, 32Bk, as photoconductors, cleaning rollers 33M, 33C, 33Y, 33Bk, and chargers 34M, 34C, 34Y, 34Bk.

The developing devices 31M, 31C, 31Y, 31Bk include developing rollers 36M, 36C, 36Y, 36Bk, respectively. A roller portion of each of the developing rollers 36M, 36C, 36Y, 36Bk is formed of a conductive silicone rubber. A surface of the roller portion of the developing roller 36M, 36C, 36Y, 36Bk is coated with resin or rubber including fluorine. The roller portion of the developing roller 36M, 36C, 36Y, 36Bk may be formed of, for example, urethane rubber. The ten point height (Rz) of the surface of the developing roller 36M, 36C, 36Y, 36Bk is set to about 3-5 m, which is smaller than the average toner particle size of about 9 μm.

The developing devices 31M, 31C, 31Y, 31Bk also include supply rollers 37M, 37C, 37Y, 37Bk, respectively. A roller portion of each supply roller 37M, 37C, 37Y, 37Bk is formed of a conductive sponge. The supply roller 37M, 37C, 37Y, 37Bk is disposed so as to press against the respective developing roller 36M, 36C, 36Y, 36Bk with an elastic force of the sponge. For the roller portions of the supply rollers 37M, 37C, 37Y, 37Bk, foaming materials, such as conductive silicone rubber, EPDM (Ethylene Propylene Diene Monomer), and urethane rubber can be used.

The developing devices 31M, 31C, 31Y, 31Bk are provided with layer-thickness regulating blades 38M, 38C, 38Y, 38Bk, respectively. Each layer-thickness regulating blade 38M, 38C, 38Y, 38Bk has a stainless steel blade formed into a plate shape whose one end is fixed to the respective developing device case 39M, 39C, 39Y, 39Bk. The other end of the stainless steel blade is provided with a pressing portion formed of insulating silicone rubber, insulating rubber or resin including fluorine. The pressing portion of the blade 38M, 38C, 38Y, 38Bk is pressed against the respective developing roller 36M, 36C, 36Y, 36Bk from above.

Each of the organic photoconductive (OPC) drums 32M, 32C, 32Y, 32Bk is formed of, for example, an aluminum base on which a positively chargeable photoconductive coating layer is formed. The thickness of the positively chargeable photoconductive coating layer is set to 20 μm or more. The aluminum base is used as a ground layer. The OPC drums 32M, 32C, 32Y, 32Bk are arranged in manner such that they are parallel to the discharge direction described below.

A roller portion of each cleaning roller 33M, 33C, 33Y, 33Bk is formed of an elastic material, such as a conductive sponge. The cleaning rollers 33M, 33C, 33Y, 33Bk slide on the respective OPC drums 32M, 32C, 32Y, 32Bk at positions obliquely below the OPC drums 32M, 32C, 32Y, 32Bk.

Each charger 34M, 34C, 34Y, 34Bk is a scorotron charger. The chargers 34M, 34C, 34Y, 34Bk are disposed downstream of the respective cleaning rollers 33M, 33C, 33Y, 33Bk with respect to a rotating direction of the OPC drums 32M, 32C, 32Y, 32Bk, so as not to contact the OPC drums 32M, 32C, 32Y, 32Bk.

The exposure device 35 is composed of a known scanner unit and disposed above the visible image forming unit 11. Surfaces of the OPC drums 32M, 32C, 32Y, 32Bk uniformly charged by the respective chargers 34M, 34C, 34Y, 34Bk are exposed to the laser light with the exposure device 35 in accordance with image data, to form an electrostatic latent image corresponding to each color on the relevant OPC drums 32M, 32C, 32Y, 32Bk.

The positively charged toner is supplied from the supply rollers 37M, 37C, 37Y, 37Bk to the respective developing rollers 36M, 36C, 36Y, 36Bk. The toner is carried on the developing rollers 36M, 36C, 36Y, 36Bk as a thin layer whose thickness has been regulated by the respective blades 38M, 38C, 38Y, 38Bk.

By supplying positively charged toner to positively charged electrostatic latent images formed on the OPC drums 32M, 32C, 32Y, 32Bk by the exposure device 35, reverse development is achieved at contact positions between the developing rollers 36M, 36C, 36Y, 36Bk and the respective OPC drums 32M, 32C, 32Y, 32Bk. Thus, a high-quality image can be formed.

The belt unit 50 includes a conveying belt 58, and a drive roller 51 and a driven roller 52 that wind the conveying belt 58 therearound. The drive roller 51 is driven by a motor (not shown) so as to rotate and accordingly the driven roller 52 rotates. Thus, the rotating belt 58 is circulated. The conveying belt 58 is an endless belt formed of resin material, such as conductive polycarbonate and polyimide, in which conductive powders, such as carbon, are dispersed. Each of transfer rollers 53 is disposed near a position where one of the OPC drums 32M, 32C, 32Y, 32Bk face the conveying belt 58.

A sheet P supplied from the sheet supplying unit 70 via a pickup roller 72 is fed by the conveying belt 58 of the belt unit 50 so as to pass between the conveying belt 58 and the OPC drums 32M, 32C, 32Y, 32Bk. While the sheet P is conveyed, the toner image carried on each OPC drum 32M, 32C, 32Y, 32Bk is sequentially transferred onto the sheet P to form a color image on the sheet P.

A cleaning unit 55 is disposed at a position opposite the OPC drums 32M, 32C, 32Y, 32Bk with respect to the conveying belt 58. The cleaning unit 55 includes a scraping member 56 and a case 57. Toner or debris attached to the conveying belt 58 is scraped by the scraping member 56 and collected to the case 57.

The fixing unit 60 includes a heat roller 61 and a pressing roller 62 that rotate while contacting each other. The heat roller 61 is provided therein with a heater 63 such as a halogen lamp that generates heat by applying power to heat the heat roller 61. A temperature sensor 64, such as a thermistor that detects surface temperatures of the heat roller 61 is disposed so as to contact the surface of the heat roller 61. In the fixing unit 60, the toner images transferred onto the sheet P are thermally fixed to the sheet P with the application of heat and pressure while the sheet P is held between the pressing roller 62 and the heat roller 61 whose temperature is controlled during the printing operation to a fixing temperature of, for example, about 180 degrees.

The sheet supplying unit 70 is disposed at a bottom portion of the housing 10*a*. The sheet supplying unit 70 includes a sheet tray 71, as a cassette, that accommodates the sheets P, and the pickup roller 72 that picks up and feeds the sheets P. The sheet supplying unit 70 supplies the sheet P by adjusting a timing with image forming processes with the exposure device 35, the developing devices 31M, 31C, 31Y, 31Bk, and the OPC drums 32M, 32C, 32Y, 32Bk. The sheet P supplied from the sheet supplying unit 70 is fed to a contact portion between the conveying belt 58 and a first feed roller 54.

The sheet output tray 80 is disposed downstream of the fixing unit 60 in the sheet feeding direction. The sheet P fed from the fixing unit 60 is discharged (output) to the sheet output tray 80 via pairs of feed rollers 91, 92, 93 in a direction (discharge direction) substantially parallel to a horizontal direction when the multi-function device 13 is placed on a flat surface for operation.

Operations of the printer 10 will be described below. While the OPC drums 32M, 32C, 32Y, 32Bk are rotated, the photoconductive coating layers on the surfaces of the OPC drums 32M, 32C, 32Y, 32Bk are uniformly charged by the respective chargers 34M, 34C, 34Y, 34Bk. The photoconductive coating layers are exposed to the laser light with the exposure device 35 in association with an image of each color of magenta, cyan, yellow, and black. Magenta, cyan, yellow, and black toner is applied by the relevant developing devices 31M, 31C, 31Y, 31Bk to the electrostatic latent images formed on the photoconductive coating layers of the OPC drums 32M, 32C, 32Y, 32Bk. Thus, development of magenta, cyan, yellow, and black color is performed. Color toner images, as developing agent images, formed on the photoconductive coating layers of the OPC drums 32M, 32C, 32Y, 32Bk are transferred on the sheet P conveyed by the conveying belt 58. Exposure timing is determined based on a moving speed of the conveying belt 58 that conveys the sheet P and the distance between the OPC drums 32M, 32C, 32Y, 32Bk. The respective color toner images are transferred on the sheet P so as to integrate the color image on the sheet P. Toner remaining on the OPC drums 32M, 32C, 32Y, 32Bk after the toner images have been transferred on the sheet P is temporarily caught by the cleaning rollers 33M, 33C, 33Y, 33Bk.

Toner images of four colors transferred on the sheet P while the sheet P is fed along the conveying belt 58 are thermally fixed on the sheet P in the fixing unit 60. Then, the sheet P is output to the sheet output tray 80. Thus, a color image is formed on the sheet P.

Figure 2:
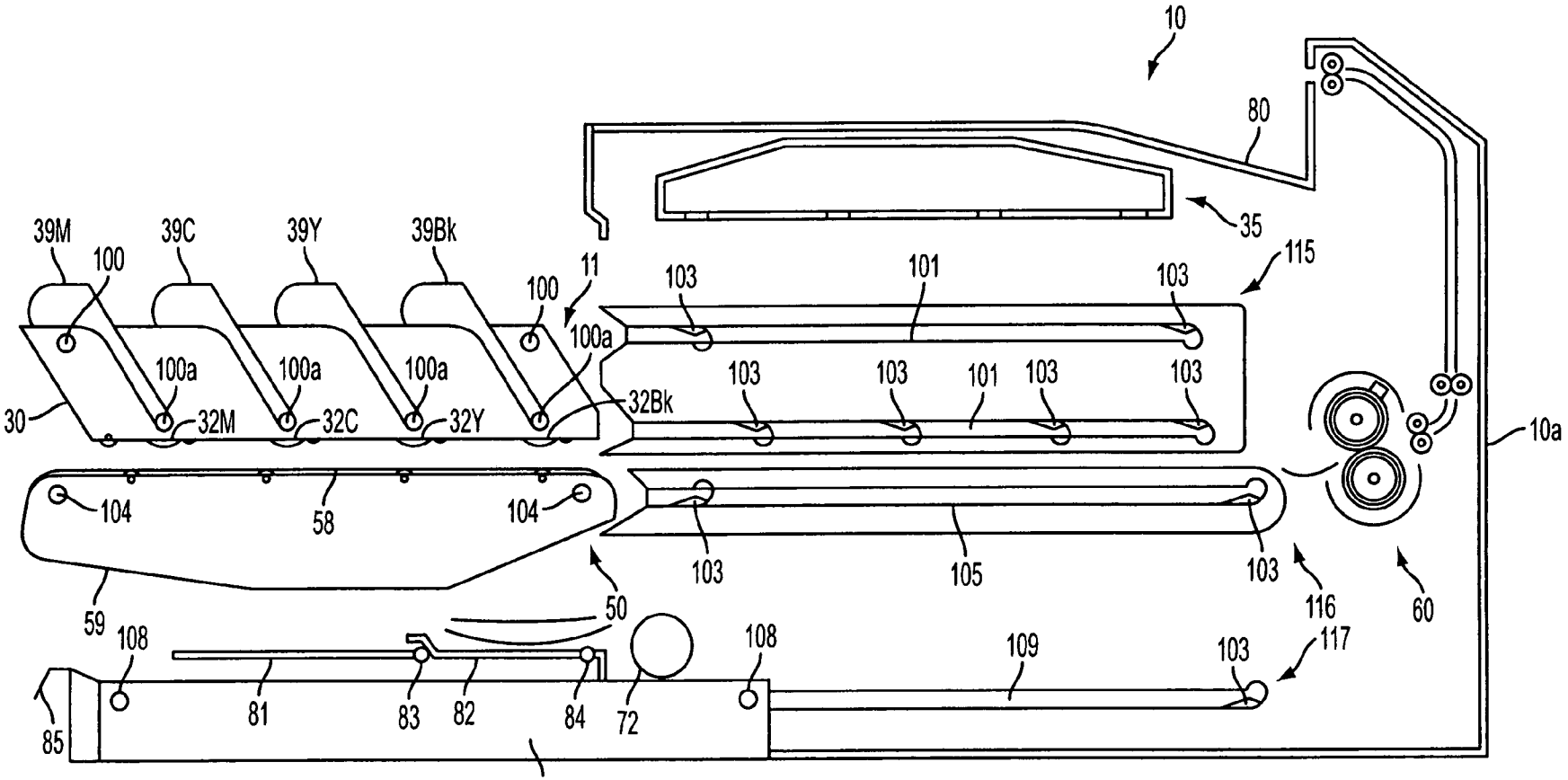
FIG. 2 is a schematic showing a cartridge, a belt holder and a sheet tray withdrawn from the printer according to an illustrative aspect.

As shown in FIG. 2, the visible image forming unit 11 is held in a cartridge 30, as a first holder. The belt unit 50 is held in a belt holder 59, as a second holder. The cartridge 30 and the belt holder 59 are removably installed in the housing 10*a* separately. Thus, the visible image forming unit 11 and the belt unit 50 can be removably installed in the printer 10 readily.

The sheet tray 71 of the sheet supplying unit 70 is removably installed in the housing 10*a* along the same direction that the cartridge 30 and the belt holder 59 are removably installed in the housing 10*a*. Thus, ease of use can be improved.

The cartridge 30, the belt holder 59, and the sheet tray 71 will be described in detail below, with reference to FIG. 2.

Engagement portions (not shown) for holding the developing device cases 39M, 39C, 39Y, 39Bk are provided in the cartridge 30. The cartridge 30 removably holds the developing device cases 39M, 39C, 39Y, 39Bk by engaging engaged portions (not shown) provided in the developing device cases 39M, 39C, 39Y, 39Bk, with the engagement portions of the cartridge 30.

A pair of projecting members 100 is provided in the cartridge 30 at its right and left ends in FIG. 2. Four supporting members 100*a* that rotatably support shafts of the OPC drums 32M, 32C, 32Y, 32Bk are provided in the cartridge 30.

A pair of the supporting members 104 for rotatably supporting shafts of the drive roller 51 and the driven roller 52 is disposed in the belt holder 59.

A pair of projecting members 108 is disposed in the sheet tray 71.

Provided in the housing 10*a* are guide mechanisms 115, 116, 117, as first, second, and third guides, respectively. The guide mechanism 115 is provided with guide grooves 101 for guiding the projecting members 100 and the supporting members 100*a* provided in the cartridge 30 into the housing 10*a* substantially horizontally from a front side of the guide mechanism 115 (from the left side in FIG. 2).

Similarly, the guide mechanism 116 is provided with a guide groove 105 for guiding the supporting members 104 provided in the belt holder 59 into the housing 10*a* substantially horizontally from a front side of the guide mechanism 116 (from the left side in FIG. 2).

The guide mechanism 117 is provided with a guide groove 109 for guiding the projecting members 108 provided in the sheet tray 71 into the housing 10*a* substantial horizontally from a front side of the guide mechanism 117 (from the left side in FIG. 2).

Stopper members 103 for elastically stopping and positioning the projecting members 100, 108 and the supporting members 100*a*, 104 are provided on each guide groove 101, 105, 109.

With the above-described structures, the cartridge 30, the belt holder 59, and the sheet tray 71 are inserted into the housing 10*a* with the aid of the guide mechanism 115, 116, 117 along the guide grooves 101, 105, 109. At an accommodation portion where the cartridge 30, the belt holder 59, and the sheet tray 71 are properly placed in the housing 10*a*, as shown in FIG. 1, the projecting members 100, 108 and the supporting members 100*a*, 104 are positioned by the stopper member 103. When the cartridge 30, the belt holder 59, and the sheet tray 71 are drawn from the housing 10*a*, the projecting members 100, 108 and the supporting members 100*a*, 104 are pulled out from the accommodation portion by the application of force opposing the elastic force of the stopper members 103. Then, the cartridge 30, the belt holder 59, and the sheet tray 71 are removed from the housing 10*a* along the relevant guide grooves 101, 105, 109 in a direction substantially parallel to a horizontal direction when the multi-function device 13 is placed on a flat surface for operation and substantially parallel to the direction in which a sheet is discharged to the output tray 80. For example, the removal directions of the cartridge 30, the belt holder 59 and the sheet tray 71 may be within 5 degrees of the sheet discharge direction.

It will be understood that "substantially parallel" as described herein refers to two lines, planes or directions being within 5 degrees of each other.

By sliding the cartridge 30 and the belt holder 59 along the guide grooves 101, 105, respectively, the cartridge 30 and the belt holder 59 can be completely removed from the housing 10*a*. A first drawing position corresponds to a position where the cartridge 30 is about to be removed from the housing 10*a* (a position immediately before the cartridge 30 is removed out from the housing 10*a*). A second drawing position corresponds to a position where the belt holder 59 is about to be removed from the housing 10*a* (a position immediately before the belt holder 59 is removed from the housing 10*a*).

To prevent the OPC drums 32M, 32C, 32Y, 32Bk from being damaged by contacting the conveying belt 58 when the cartridge 30 or the belt holder 59 are removably installed in the housing 10*a*, the guide grooves 101, 105 are structured to bring the OPC drums 32M, 32C, 32Y, 32Bk into contact with the conveying belt 58 when the projecting members 100 and the supporting members 100*a*, 104 reach the accommodation portion where the cartridge 30 and the belt holder 59 are placed in position in the housing 10*a*.

When the projecting members 100 and the supporting members 100*a*, 104 are removed from the accommodation portions, the OPC drums 32M, 32C, 32Y, 32Bk are moved away or spaced apart from the conveying belt 58.

The guide mechanisms 115, 116, 117 are individually provided in the housing 10*a*, such that the cartridge 30, the belt holder 59, and the sheet tray 71 can be individually installed in or removed from the housing 10*a* in a direction substantially parallel to each other.

To allow the cartridge 30 and the belt holder 59 to be removably installed in the housing 10*a*, a front lower cover 82, as a second cover, is pivotally disposed about a supporting shaft 84 at a front side of the housing 10*a* so as to open or close, and a front cover 81, as a first cover, is pivotally disposed about a supporting shaft 83 on the front lower cover 82.

Figure 3:
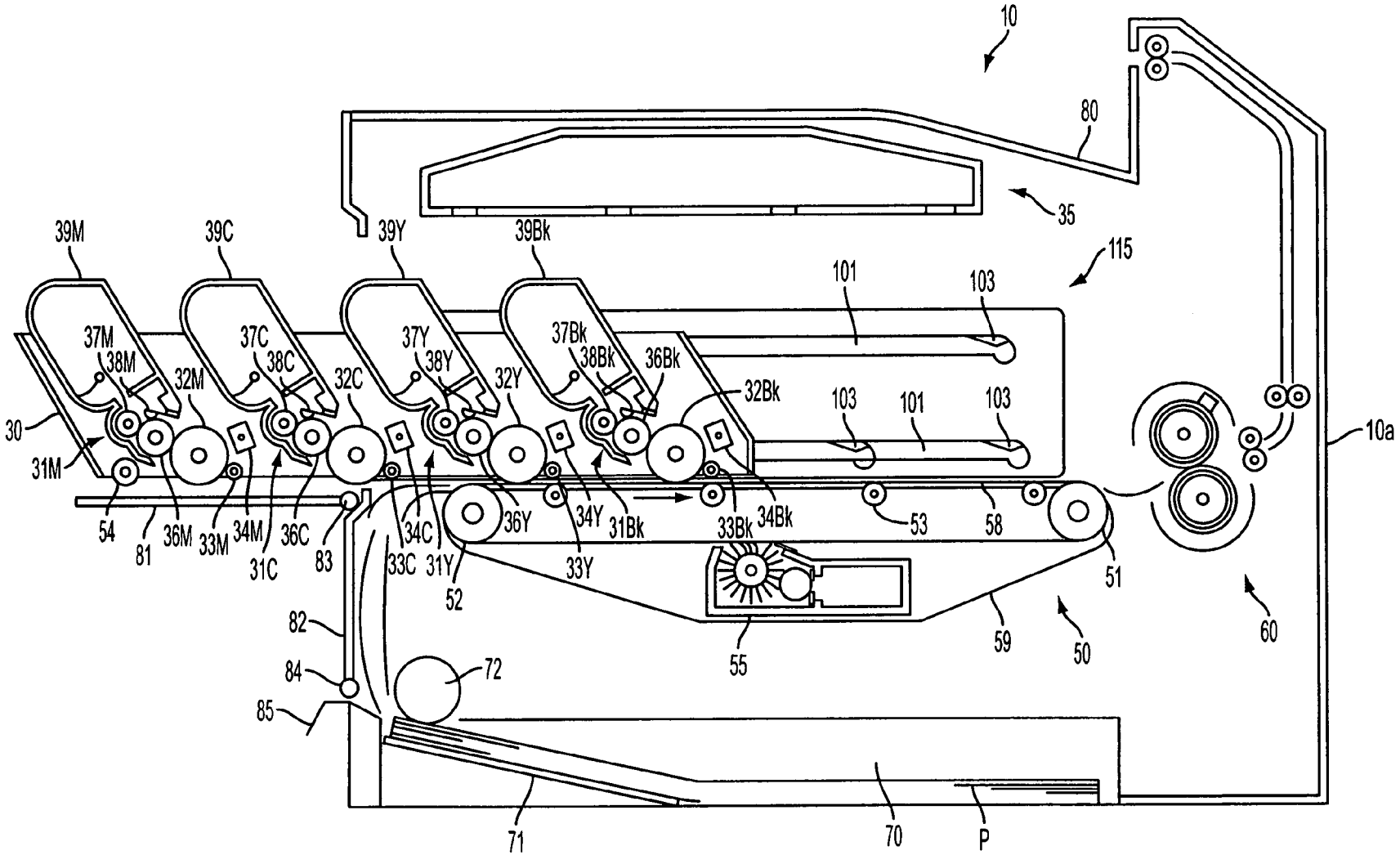
FIG. 3 is a schematic showing the cartridge withdrawn from the printer according to an illustrative aspect.
Figure 4:
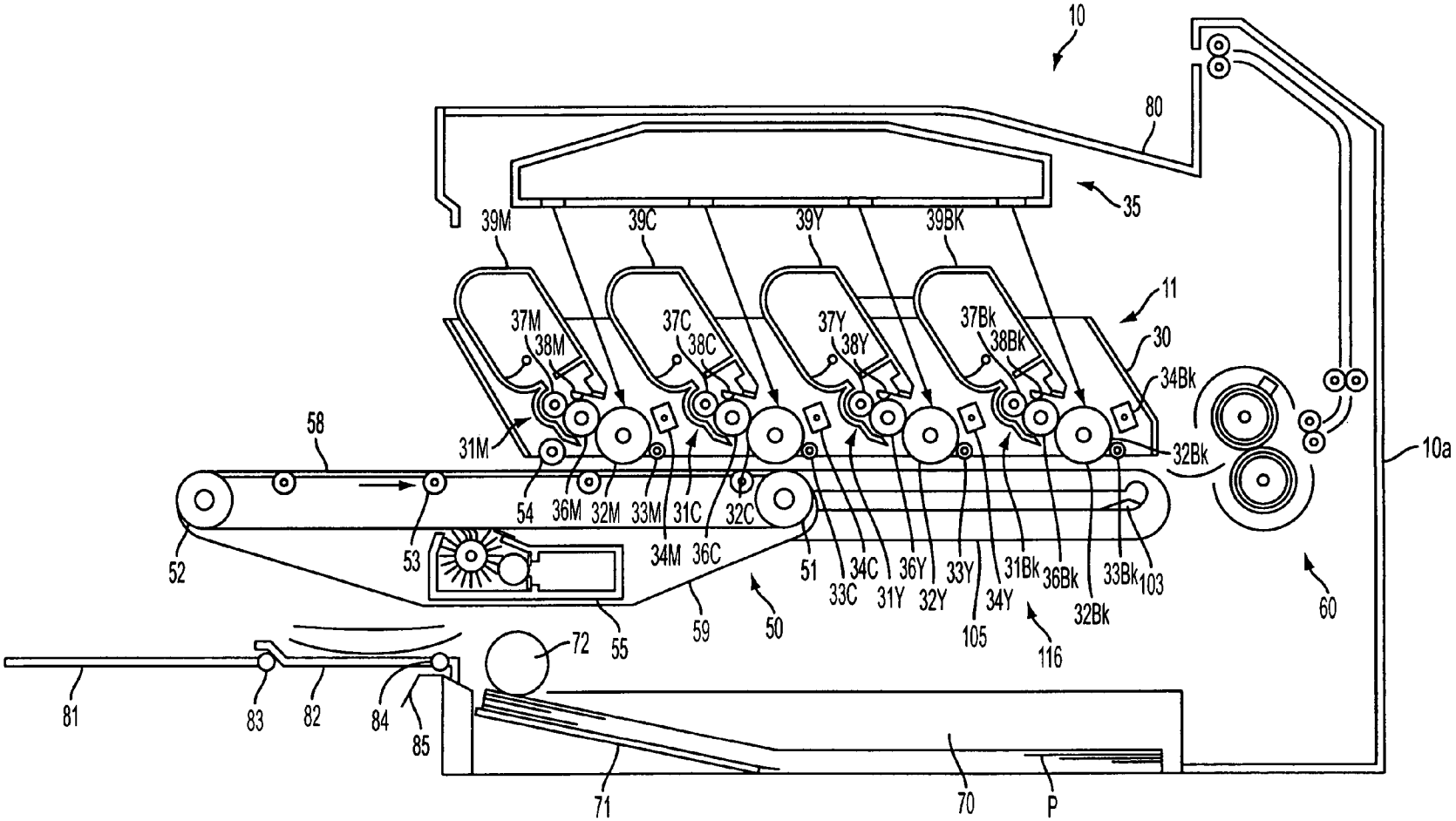
FIG. 4 is a schematic showing the belt holder withdrawn from the printer according to an illustrative aspect.

As shown in FIG. 3, as the front cover 81 is opened, the cartridge 30 can be removed from the housing 10*a*. As shown in FIG. 4, as the front lower cover 82 is opened together with the front cover 81, the belt holder 59 can be removed from the housing 10*a*. It will be appreciated that the front cover 81 and the front lower cover 82 may be replaced by a single front cover.

When a handle 85 is pulled toward the front side of the housing 10*a*, the sheet tray 71 can be removed from the housing 10*a*.

In the printer 10, components of the visible image forming unit 11 are integrally contained in the cartridge 30. By sliding the cartridge 30 along the guide mechanism 115 provided in the housing 10*a*, the cartridge 30 can be readily installed in or removed from the housing 10*a*. Similarly, by sliding the belt holder 59 and the sheet tray 71 along the guide mechanism 116, 117, the belt holder 59 and the sheet tray 71 can be readily installed in or removed from the housing 10*a*. Thus, the cartridge 30, the belt holder 59, and the sheet tray 71 can be readily installed in or removed from the housing 10*a*, leading to the improvement of the maintainability of the printer 10.

Because a removing or drawing direction of the cartridge 30, the belt holder 59, and the sheet tray 71 is substantially horizontal, the cartridge 30, the belt holder 59, and the sheet tray 71 can be drawn with a lighter force. When the cartridge 30 and the belt holder 59 are placed in position by the guide mechanisms 115, 116, a fine quality image can be formed.

Further, as the sheet tray 71 is placed in position by the guide mechanism 117, the sheet P can be supplied from the tray 71 properly.

Because the cartridge 30, the belt holder 59, and the sheet tray 71 can be drawn in the same direction, their handling can be facilitated and maintainability can be improved. Further, spaces for removably setting the cartridge 30, the belt holder 59, and the sheet tray 71 may be provided on the same side of the housing 10*a*. Thus, limitations on installation of the components of the printer 10 can be reduced.

For example, if the cartridge 30, the belt holder 59, and the sheet tray 71 are drawn in an axial direction of a roller of the housing 10*a*, such as the OPC drum 32M, 32C, 32Y, 32Bk, a relatively large hole needs to be formed in a frame for supporting a shaft of the roller. Accordingly, the rigidity of the printer 10 is reduced. However, in illustrative aspects of the invention, the cartridge 30, the belt holder 59, and the sheet tray 71 can be drawn in a substantially horizontal direction perpendicular to an axial direction of a roller. Therefore, an increase in rigidity of the printer 10 can be achieved because it is unnecessary to form a hole in the frame.

If such a structure is employed that various rollers are drawn along their axial direction, bearings for receiving or supporting the rollers need to be withdrawn, so that positioning the bearings becomes difficult, resulting in complicated structures. However, the printer 10 can avoid having such difficult structures.

Figure 5A:
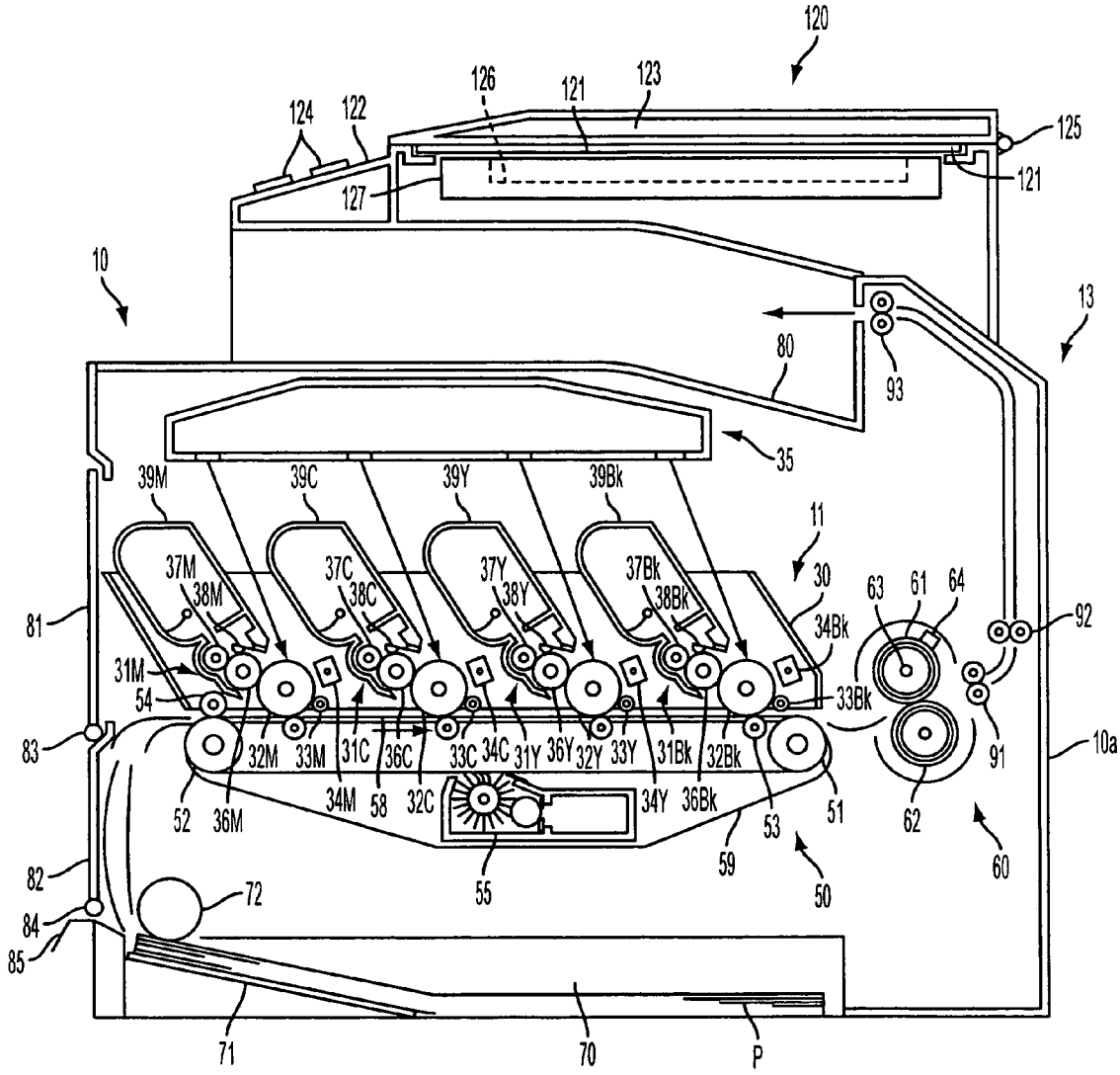
FIGS. 5A and 5B are side sectional views of a general configuration of a multi-function device according to other illustrative aspects.
Figure 5B:
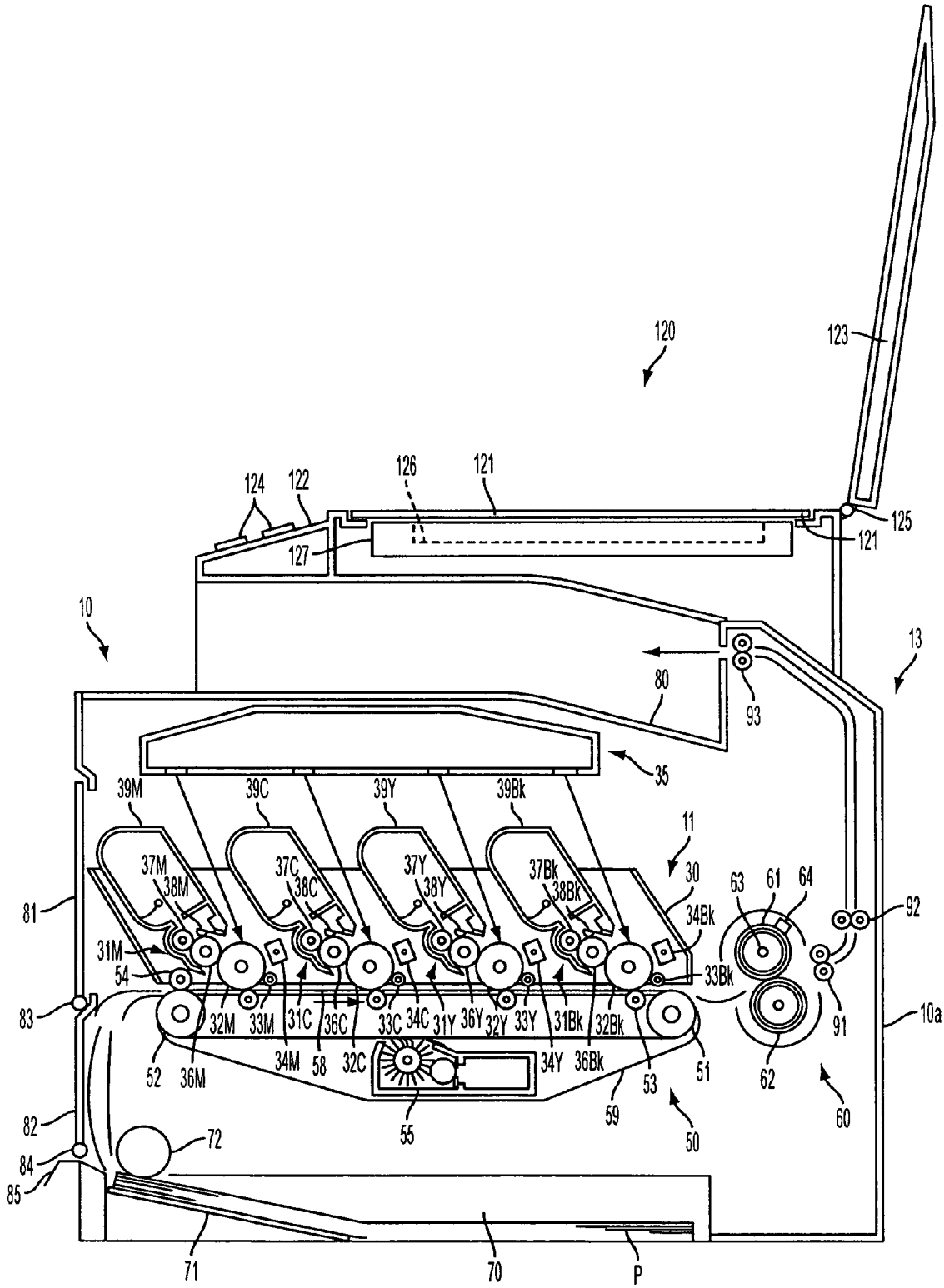

Referring to FIGS. 5A and 5B, a multi-function device 13, according to other aspects of the invention, including a scanner, as an image reading device, will be described below.

In the multi-function device 13, as shown in FIGS. 5A and 5B, a scanner 120 is disposed above the printer 10 and together with the printer 10 in the housing 10*a*, parallel to the bottom of the housing 10*a*. The scanner 120 includes a table 121 made of a transparent material such as platen glass for receiving a document to be scanned, an optical system 126, positioned below the table 121, for transmitting light toward the table 121 when a scanning operation occurs, a carrier 127 for moving the optical system 126 to scan the document in a direction substantially perpendicular to the discharge direction, a cover 123 for covering the table 121, a hinge 125 for coupling the cover 123 to the table 121, where the hinge allows the cover 123 to move between an open position and a closed position. In an illustrative example, the direction in which the carrier 127 moves the optical system 126 may be between 85 and 95 degrees away from the discharge direction associated with the sheet output tray 80. The scanner 120 is provided with a control panel 122, which may be coupled to the table 121, including an operation portion 124 for operating the scanner 120 and the printer 10. A sheet output tray 80 for receiving the sheets P output from the printer 10 is disposed between the scanner 120 and the printer 10. In the multi-function device 13, the scanner 120 is disposed at an upper portion of the multi-function device 13. With such a structure, image scanning and printing can be readily performed. Thus, the multi-function device 13 can be provided with good usability.

Figure 6:
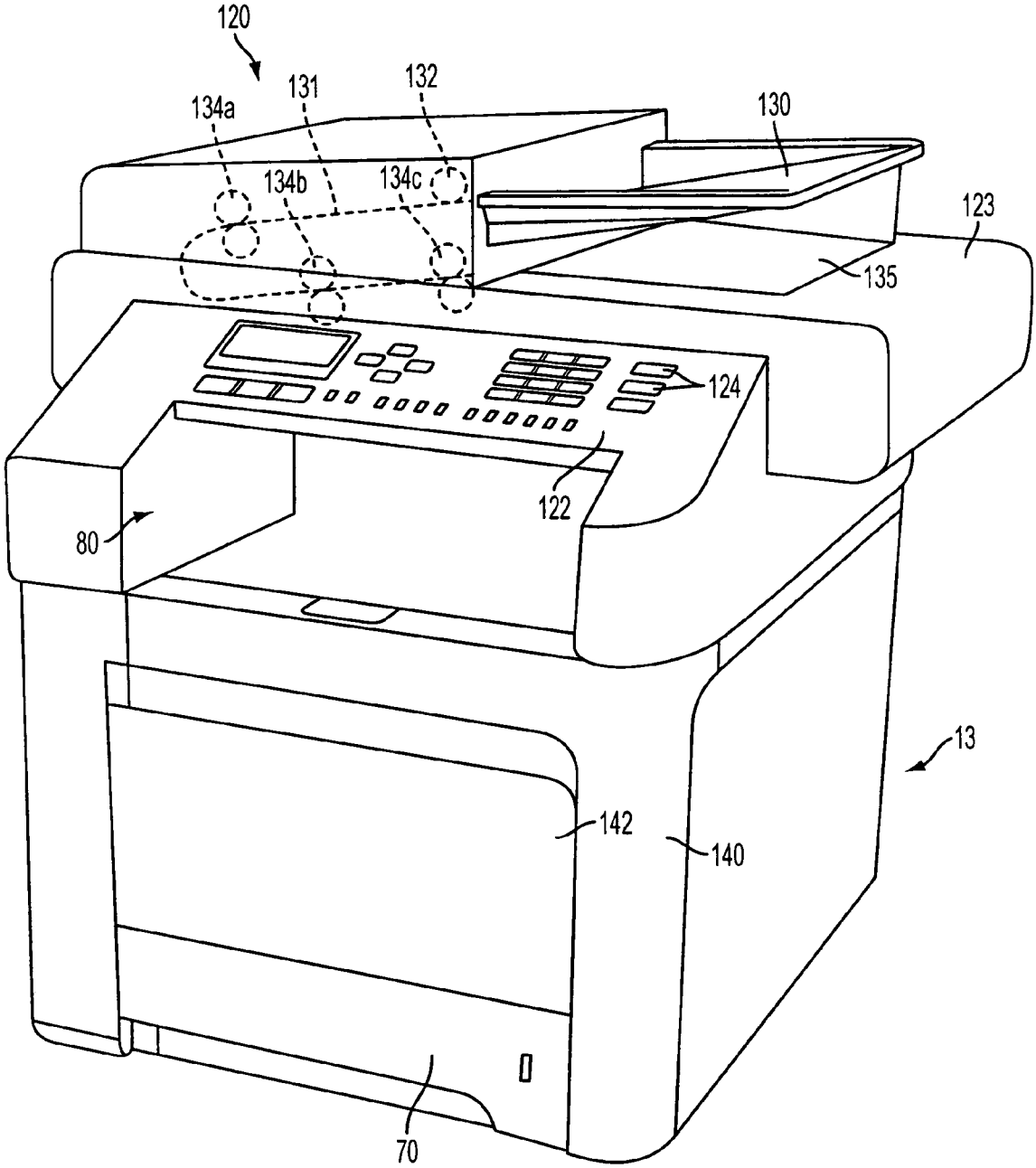
FIG. 6 is a view of a general configuration of a multi-function device where the scanner includes a document feeder according to another illustrative aspect.

FIG. 6 shows a multi-function device 13 with a document feeder as part of the cover 123. The document feeder includes an input tray 130, a pickup roller 132, roller pairs 134*a*, 134*b*, discharge roller pair 134*c* and output tray 135. In one form of operation of the scanner 120, a document to be scanned is handled by the document feeder as follows. The document is placed in the input tray 130 and is drawn into the scanning path 131 by the pickup roller 132. The pickup roller 132 transports the document along the scanning path 131 to a first pair of rollers 134*a*. The first pair of rollers 134*a* passes the document by the optical system 126 for scanning to the second pair of rollers 134*b*. The second roller pair 134*b* passes the document to the discharge roller pair 134*c*, which discharges the document to the output tray 135 in the scanning discharge direction. The scanning discharge direction is substantially perpendicular to the discharge direction in which a sheet is discharged to the sheet output tray 80 described previously. For example, the scanning discharge direction may be between 85 and 95 degrees away from the discharge direction associated with the sheet output tray 80.

The scanner 120 is disposed in the top portion of the housing 10*a* substantially parallel to the bottom of the housing 10*a*, that is, substantially horizontally. Accordingly, when the cartridge 30 is removed, the cartridge 30 can be smoothly drawn without interference from the scanner 120.

The sheet output tray 80 is disposed between the printer 10 and the scanner 120. Because the sheet output tray 80 is provided in the multi-function device 13 so as not to project or stand out, the space occupied by the multi-function device 13 can be reduced.

The control panel 122 including the operation portion 124, which is operated by a user, is disposed in the scanner 120 at an upper part of the multi-function device 13. In one illustrative implementation as shown, the control panel 122 may slope away from the front end of the table 121 toward the side of the housing 10*a* from which the cartridge 30 may be removed. In this example, the control panel 122 need not extend to reach the side of the housing 10*a* from which the cartridge 30 may be removed; rather the control panel 122 may be behind this portion. With the structure, the control panel 122 can be readily operated, as compared with a scenario where the control panel 122 is disposed on a front surface of the housing 10*a*. For example, the control panel 122 is oriented such that the user may easily read and operate the multi-function device 13.

FIG. 5B is provided to show an alternate configuration of the scanner 120, where the rear end of the table 121 is located in a different position, namely, between a portion of the housing 10*a* from where the cartridge 30 is removable and a portion opposite that portion of the housing 10*a*, where a line connecting the portions is parallel to the table 121. With such an arrangement the cover 123 may be opened passed the vertical position as shown in FIG. 5B when the rearmost portion of the housing 10*a* of the multi-function device 13 is located up against or very close to a flat surface such as a wall.

Figure 7:
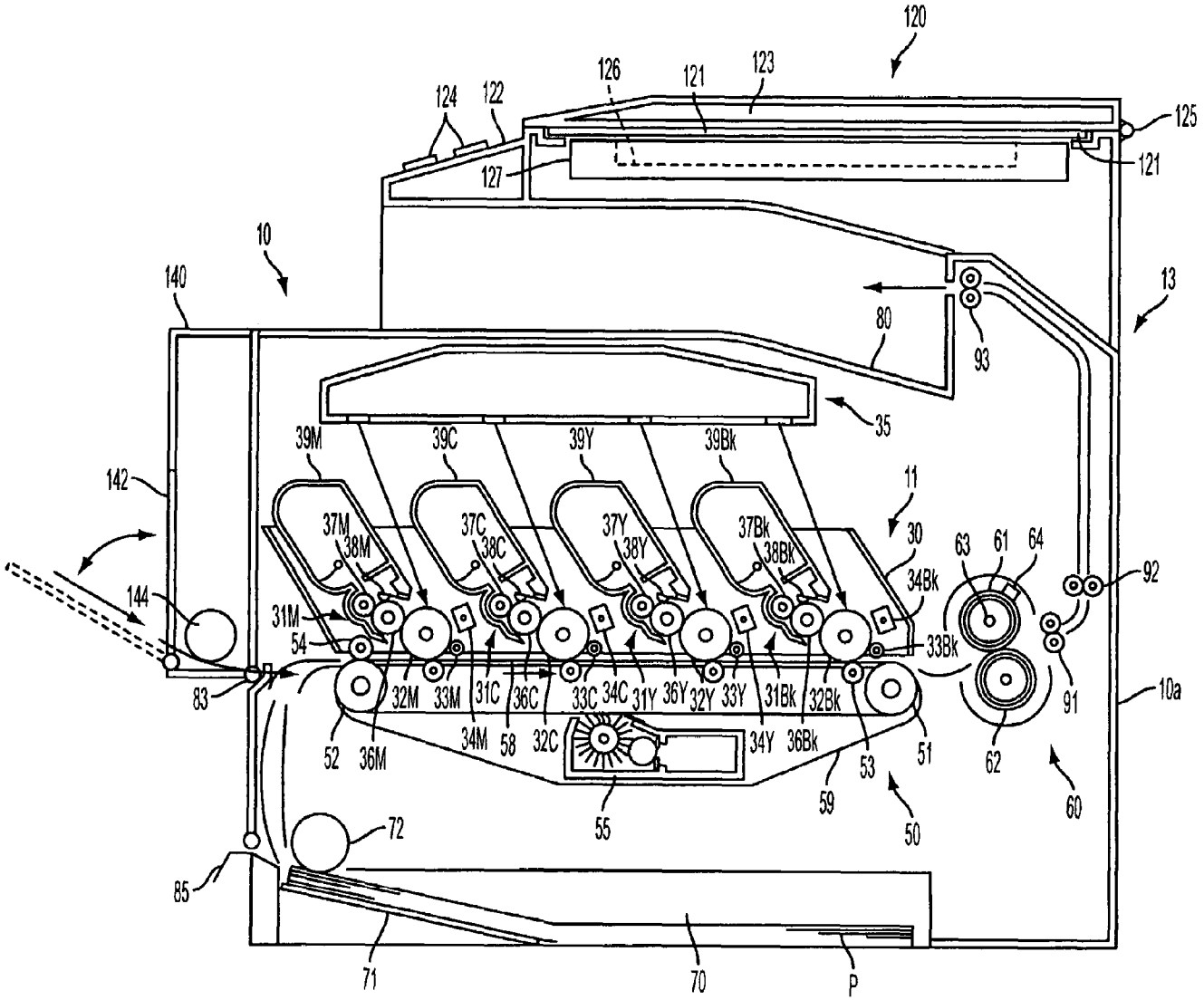
FIG. 7 is a side sectional view of a general configuration of a multi-function device according to another illustrative aspect.

FIG. 7 is an alternate multi-function device 13 implementation which is modified from FIG. 5A. In FIG. 7, the front cover 140 includes a built in manual feed tray 142 that can be opened to receive a sheet for manual feeding to the conveying belt 58 when the front cover 140 remains in a closed position. When a sheet is placed in the manual feed tray 142 and a user requests a printing operation, pickup roller 144 draws the sheet from the manual feed tray 142 onto the conveying belt 58 for further handling.

Figure 8:
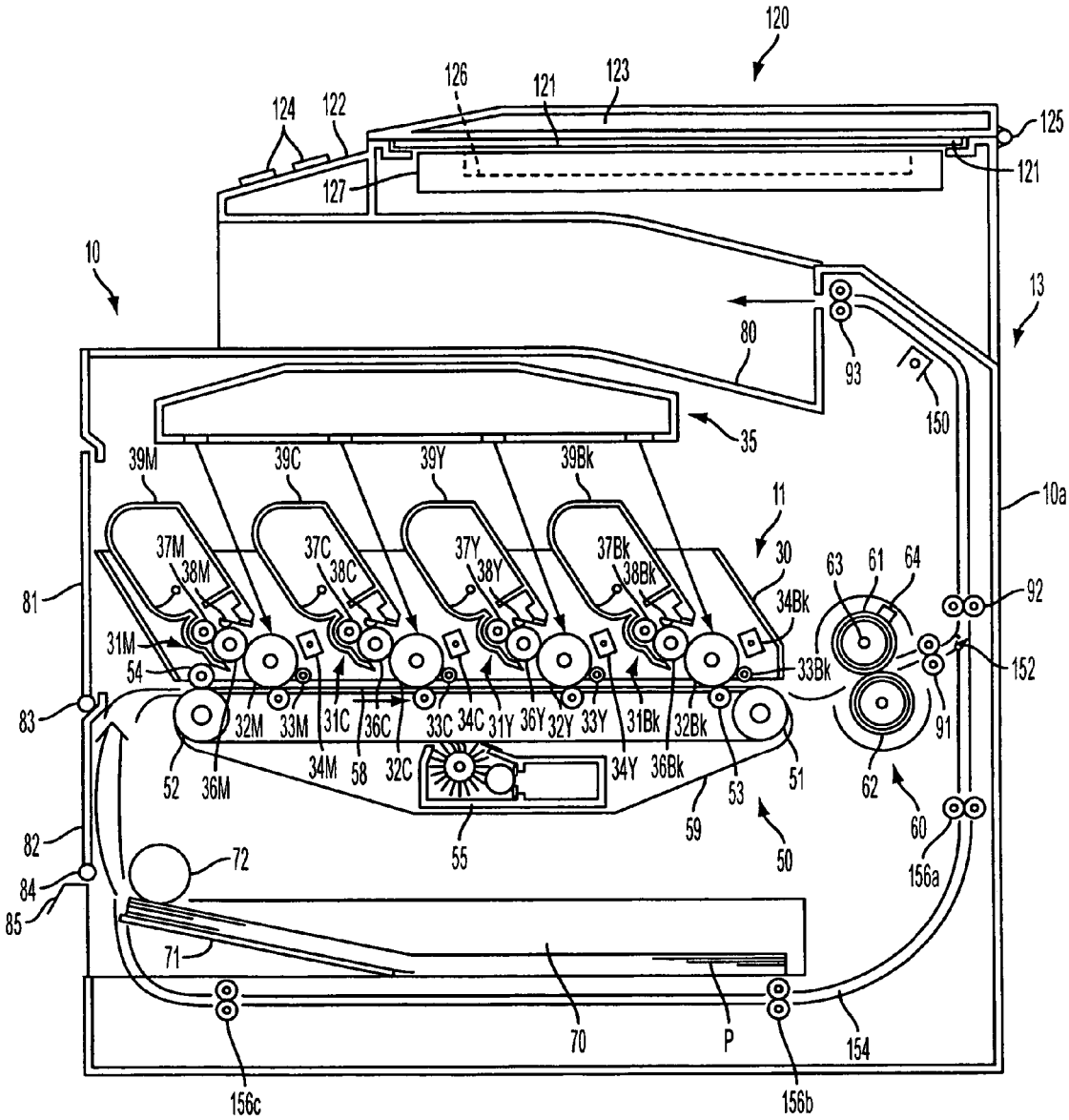
FIG. 8 is a side sectional view of a general configuration of a multi-function device according to another illustrative aspect.

FIG. 8 is another alternate multi-function device 13 implementation which is modified from FIG. 5A. The multi-function device 13 of FIG. 8 has been configured to accommodate duplex printing. When a user requests duplex operation, the first time that a sheet P passes through the fixing unit 60 to the feed rollers 91, 92 and 93, the sheet P does not get discharged to the output tray 80. Rather, a sensor 150 positioned, for example, near to the feed rollers 93 detects the leading edge of the sheet P. Once a predefined time period elapses following detection by the sensor 50 (i.e., to allow the sheet P to clear the fixing unit 60 and feed rollers 91), the feed rollers 92 and 93 are reversed, a guide 152, which is movable between two positions (as shown) is set to guide the sheet P to the duplex feeding path 154, which is located below the sheet tray 71. Rollers pairs 156*a*, 156*b*, 156*c* in the duplex feeding path transport the sheet P to the conveying belt 58 so that the second side of the sheet P may be printed on. Once the sheet P clears the fixing unit 60 for the second time, it will then pass the feed rollers 91, 92, 93 to be discharged to the output tray 80.

Figure 9:
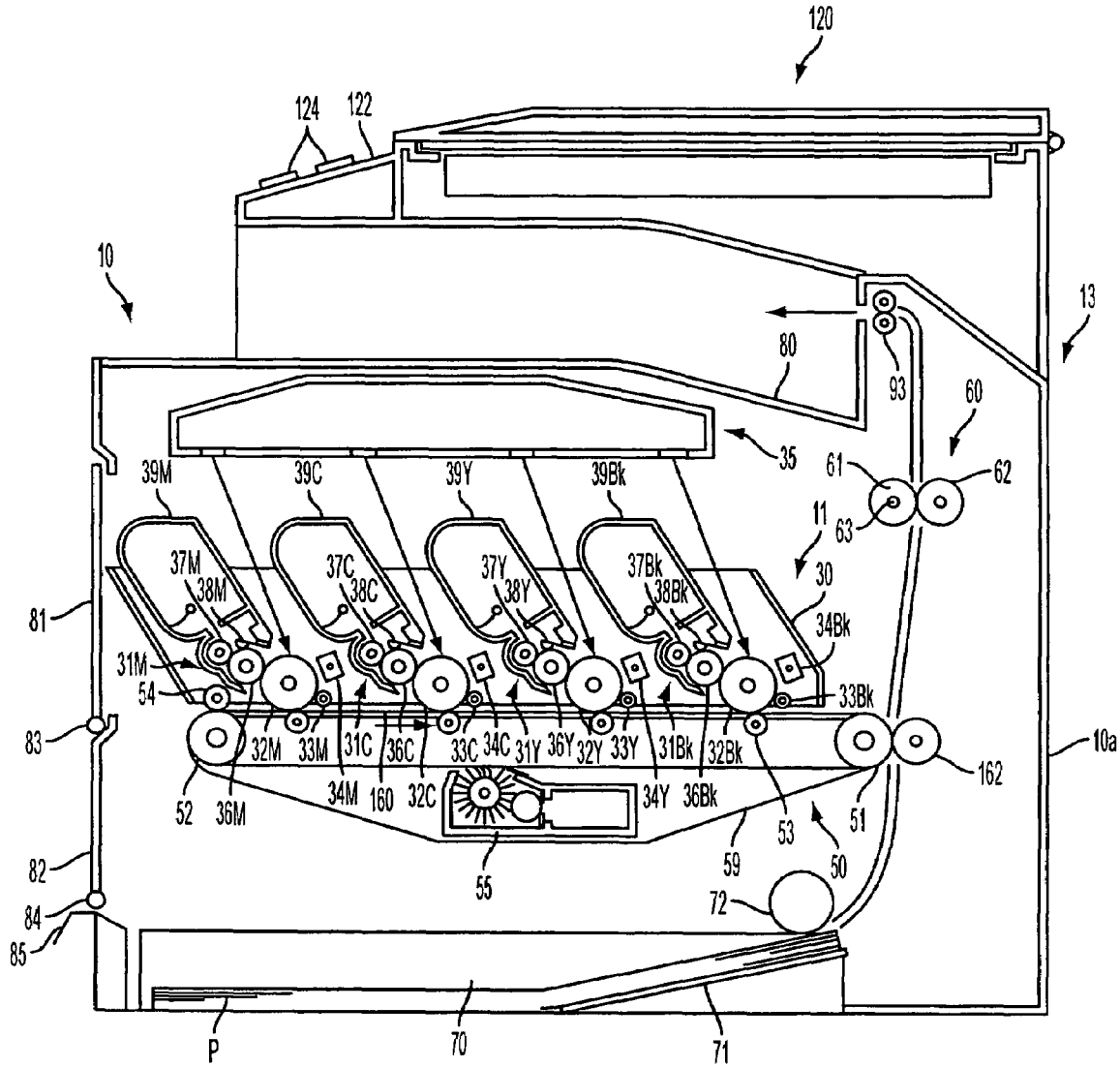
FIG. 9 is a side sectional view of a general configuration of a multi-function device according to another illustrative aspect.

FIG. 9 is another alternate multi-function device 13 implementation. The sheet supplying unit 70 is configured oppositely from FIGS. 5A and 5B. The pickup roller 72 is located away from the front cover opposite from FIGS. 5A and 5B. The pickup roller 72 picks up and feed a sheet P to a contact portion between the intermediate belt 160 and a transfer roller 162. The OPC drums 32M, 32C, 32Y, 32Bk contact the intermediate belt 160, and are configured to transfer color toner images, as developing agent images, to the intermediate belt 160. When an image has been transferred from the OPC drums 32M, 32C, 32Y, 32Bk to the intermediate belt 160, the intermediate belt 160 with the aid of the transfer roller 162 transfers the developing agent images from the belt 160 to the sheet P when the sheet P passes between the intermediate belt 160 and the transfer roller 162. Thereafter, the fixing unit 60 operates as described previously to affix the toner to the sheet P. Then, the sheet passes through roller pair 93 for discharge to the output tray 80. It will be appreciated that the intermediate belt 160 can be removed from the housing 10*a* in the same manners as described with respect to the conveying belt 58.

While this disclosure has been described in conjunction with the exemplary aspects outlined above, various alternatives, modifications, variations, improvements and/or substantial equivalents, whether known or may be presently unforeseeable, may become apparent to those having at least ordinary skill in the art. Accordingly, the exemplary aspects of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

For example, in the above disclosure, the printer of a direct transfer type is described in which images are transferred directly from the OPC drums 32M, 32C, 32Y, 32Bk, to the sheet P. However, the aspects of the invention may be applied to a printer of an intermediate transfer type in which images are first transferred on an intermediate transfer belt and then on the sheet P.

In the above disclosure, the conveying belt 58 extends between two drive and driven rollers 51, 52 in one direction. However, the conveying belt 58 may extend between three or more rollers in two or more directions.

In the above disclosure, the belt holder 59 is disposed below the cartridge 30. However, the belt holder 59 may be disposed above the cartridge 30. In this case, the developing device case 39 may open upward. Thus, leakage of the toner may be prevented.

In the above disclosure, when the cartridge 30 or the belt holder 59 is drawn to a certain position, the cartridge 30 or the belt holder 59 is removed from the housing 10*a*, without being stopped during drawing. However, a stopper for stopping the cartridge 30/the belt holder 59 at a certain position may be provided to stop the drawing of the cartridge 30/the belt holder 59.

What is claimed is:

1. An image forming apparatus comprising:

a housing;

a plurality of photoconductors on which an electrostatic latent image is formed;

a plurality of developing devices, each including a developing agent carrier for holding a developing agent thereon;

a belt unit including a belt frame, a belt support roller that is coupled to the belt frame, and a belt that is supported by the belt support roller;

a holder for supporting the plurality of photoconductors and the plurality of developing devices, the holder being removable from the housing;

an image reader, provided at a top portion of the housing, configured to read an image on a document, wherein the belt unit is configured to be removed from the housing without the holder being removed from the housing, a sheet container configured to accommodate a stack of sheets, the sheet container being removable from the housing;

wherein the housing further includes:

a front cover provided at a front surface of the housing, the front cover being movable between an open position and a closed position;

a first area, provided inside the housing, configured to receive the holder when the front cover is in the open position;

a second area, provided inside the housing, configured to receive the sheet container;

a first sheet path that substantially extends in a horizontal direction below the holder when the holder is received in the first area, the first sheet path configured to guide a sheet to the plurality of photoconductors; and a sheet discharging portion that is coupled to the first sheet path and extends above the holder when the holder is received in the first area, the sheet discharging portion being configured to transport the sheet from the plurality of photoconductors and to discharge the sheet toward the front surface in a first direction.

2. The image forming apparatus according to claim 1, wherein the image reader includes a document feeder configured to feed the document in a second direction substantially perpendicular to the first direction.

3. The image forming apparatus according to claim 2, wherein the second direction is 85 to 95 degrees away from the first direction.

4. The image forming apparatus according to claim 1, wherein the holder is configured to be removed from the first area through an opening in a second direction that is substantially parallel to the first direction when the front cover is in the open position.

5. The image forming apparatus according to claim 4, wherein the first direction is within 5 degrees of the second direction.

6. The image forming apparatus according to claim 4, wherein the sheet container is configured to be removed from the second area in a third direction that is substantially parallel to the first direction.

7. The image forming apparatus according to claim 6, wherein the first direction is within 5 degrees of the third direction.

8. The image forming apparatus according to claim 1, wherein the front cover further comprises:

an opening configured to receive a sheet for passage to the first sheet path.

9. The image forming apparatus according to claim 1, wherein the belt unit is configured to be positioned between the holder and the sheet container when the holder is received in the first area and the sheet container is received in the second area, and, wherein the belt is configured to guide the sheet in the first sheet path.

10. The image forming apparatus according to claim 9, wherein the housing further includes:

a third area provided inside the housing, the third area configured to receive the belt unit.

11. The image forming apparatus according to claim 10, wherein the belt unit is configured to be removed from the third area when the front cover is in the open position.

12. The image forming apparatus according to claim 10, further comprising:

a first cover for covering the first area; and a second cover for covering the third area, wherein the first cover is configured to be moved and the second cover is configured to be moved relative to the first cover.

13. The image forming apparatus according to claim 1, further comprises:

a second sheet path that extends under the first sheet path, the second sheet path configured to guide the sheet from the sheet discharging portion to the first sheet path the first time the sheet enters the sheet discharging portion in duplex operation.

14. The image forming apparatus according to claim 13, wherein the second sheet path is provided below the sheet container.

15. The image forming apparatus according to claim 1, wherein a direction of alignment of the plurality of photoconductors is parallel to the first direction.

16. The image forming apparatus according to claim 1, wherein the image reader includes:

a table configured to receive a document to be processed; and a cover that covers the table.

17. The image forming apparatus according to claim 16, wherein the cover is coupled to the table with a hinge to allow for movement of the cover between an open position and a closed position.

18. The image forming apparatus according to claim 17, wherein a front end of the table is closer than a rear end of the table to a portion of the housing from where the holder is removable, the hinge being provided at the rear end of the table.

19. The image forming apparatus according to claim 18, wherein the rear end of the table is between a portion of the housing from where the holder is removable and a portion opposite that portion of the housing, where a line connecting the portions is parallel to the table.

20. The image forming apparatus according to claim 16, further including a control panel positioned on the housing and coupled to the table.

21. The image forming apparatus according to claim 20, wherein a front end of the table is closer than a rear end of the table to the portion of the housing from where the holder is removable, the control panel being coupled to the front end of the table.

22. The image forming apparatus according to claim 21, wherein the control panel is positioned to slope from the front end of the table toward the portion of the housing from where the holder is removable.

23. The image forming apparatus according to claim 21, wherein the control panel is provided at the front end of the table behind the portion of the housing from where the holder is removable.

24. The image forming apparatus according to claim 16, wherein the table is formed of a transparent material and configured to receive the document;

wherein the image reader further comprises:

an optical system configured to transmit light toward the table; and a carrier configured to move the optical system in a second direction substantially perpendicular to the first direction.

25. The image forming apparatus according to claim 24, wherein the second direction is 85 to 95 degrees away from the first direction.

26. The image forming apparatus according to claim 1 wherein the belt unit is configured to be positioned between the holder and the sheet container when the holder is received in the first area and the sheet container is received in the second area.

27. The image forming apparatus according to claim 26, wherein the belt is configured to receive the developing agent from the plurality of photoconductors and to transfer the developing agent to a sheet.

28. The image forming apparatus according to claim 26, wherein the housing further includes:

a third area inside the housing, the third area configured to receive the belt unit.

29. The image forming apparatus according to claim 28, wherein the belt unit is configured to be removed from the third area when the front cover is in the open position and the holder is removed from the first area.

30. The image forming apparatus according to claim 28, wherein the holder is configured to be removed from the first area in a first direction and the belt unit is configured to be removed from the third area in a second direction that is substantially parallel to the first direction.

31. The image forming apparatus according to claim 30, wherein the first direction is within 5 degrees of the second direction.

32. An image forming apparatus, comprising:

a housing;

a photoconductor on which an electrostatic latent image is formed, the photoconductor being supported by a supporting shaft;

a plurality of developing devices, each including at least a developing agent chamber configured to include a developing agent and a developing agent carrier configured to hold the developing agent thereon;

a transfer device including a belt member and a roller, the transfer device configured to transfer a visible image formed on the photoconductor to a recording medium;

a first holder configured to hold the plurality of the developing devices along a first direction perpendicular to the supporting shaft of the photoconductor, the first holder being placed in a first area in the housing;

a first guide configured to guide the first holder in and out of the first area in the first direction;

a second holder configured to hold the belt member and the roller for supporting the belt member, the second holder being placed in a second area in the housing; and a second guide configured to guide the second holder in and out of the second area in a second direction substantially parallel to the first direction, wherein the second holder is configured to be guided out of the second area in the housing by the second guide while the first holder remains in the first area in the housing.

33. The image forming apparatus according to claim 32, wherein the first holder is configured to be guided out of the first area in the housing by the first guide while the second holder remains in the second area in the housing.

34. The image forming apparatus according to claim 32, wherein the photoconductor is held in the first holder.

35. The image forming apparatus according to claim 32, wherein the photoconductor and the belt member contact each other when the first holder and the second holder are placed in the first area and the second area, respectively, and the photoconductor and the belt member separate from each other when at least one of the first holder and the second holder is moved out of the first area and second area, respectively.

36. The image forming apparatus according to claim 32, further comprising:

a sheet container configured to include the recording medium before an image is formed, the sheet container being configured to be attachable to and removable from the housing; and a third guide configured to guide the sheet container in a third direction substantially parallel to the first direction.

37. The image forming apparatus according to claim 32, farther comprising:

an image reading device configured to read an image on a document and generate image data, the image reading device being disposed at an upper portion of the housing; and an electrostatic latent image forming device configured to form the electrostatic latent image on the photoconductor based on the image data generated by the image reading device.

38. The image forming apparatus according to claim 37, further comprising a discharging portion configured to discharge the recording medium on which the image is formed, the discharging portion being disposed between the image reading device and the first holder when placed in the first area.

39. The image forming apparatus according to claim 32, wherein the first holder and the second holder are configured to be guided out of the housing by the first guide and second guide, respectively, in a direction that is substantially parallel to a horizontal direction, when the image forming apparatus is placed on a flat surface for operation.

40. An image forming apparatus comprising:

a housing;

a photoconductor on which an electrostatic latent image is formed, the photoconductor members being supported by a corresponding supporting shaft;

a plurality of developing devices, each including at least a developing agent chamber configured to include a developing agent and a developing agent carrier configured to hold the developing agent thereon;

a transfer device including a belt member and a roller, the transfer device configured to transfer a visible image formed on the photoconductor to a recording medium;

a first holder configured to hold the plurality of the developing devices along a first direction perpendicular to the supporting shaft of the photoconductor member, the first holder being placed in a first area in the housing;

a first guide configured to guide the first holder in and out of the first area in the first direction;

a second holder configured to hold the belt member and the roller for supporting the belt member, the second holder being placed in a second area in the housing;

a second guide configured to guide the second holder in and out of the second area in a second direction substantially parallel to the first direction;

a first cover for covering the first area; and a second cover for covering the second area, wherein the first cover is configured to be moved and the second cover is configured to be moved relative to the first cover.

* * * * *